US005210464A

United States Patent [19]

Dunham et al.

[11] Patent Number: 5,210,464

[45] Date of Patent: May 11, 1993

[54] CAVITY RESONANCE ABSORPTION IN ULTRA-HIGH BANDWIDTH CRT DEFLECTION STRUCTURE BY A RESISTIVE LOAD

[75] Inventors: Mark E. Dunham, Santa Cruz, N. Mex.; Charles L. Hudson, Santa Barbara, Calif.

[73] Assignee: The United States of America as represented by the Department of Energy, Washington, D.C.

[21] Appl. No.: 700,286

[22] Filed: May 15, 1991

[51] Int. Cl.[5] ..... H01J 23/10

[52] U.S. Cl. ..... 315/3; 315/5.24; 333/22 R; 313/421; 313/431

[58] Field of Search ..... 315/3, 5.24, 7, 8; 313/421, 431; 333/22 R

[56] References Cited

U.S. PATENT DOCUMENTS

| | | | |
|---|---|---|---|
| 2,438,915 | 4/1948 | Hansen | 333/34 X |
| 3,376,464 | 4/1968 | Loty et al. | 315/3 |
| 4,035,687 | 7/1977 | Gross | 315/3.5 |
| 4,158,791 | 6/1979 | Lien et al. | 315/3.5 |
| 4,358,704 | 11/1982 | Conquest | 315/3.5 |
| 4,564,787 | 1/1986 | Kosmahl | 315/3.6 |
| 4,639,640 | 1/1987 | Hata et al. | 315/3 |
| 4,812,707 | 3/1989 | Correll | 313/435 |
| 4,851,736 | 7/1989 | Harper et al. | 315/3.5 |
| 4,859,907 | 8/1989 | Busacca et al. | 315/3.5 |
| 5,047,737 | 9/1991 | Oldfield | 333/22 R |

FOREIGN PATENT DOCUMENTS

| | | | |
|---|---|---|---|
| 1128306 | 12/1984 | U.S.S.R. | 313/421 |

*Primary Examiner*—Robert J. Pascal
*Assistant Examiner*—Benny T. Lee
*Attorney, Agent, or Firm*—Miguel A. Valdes; Roger S. Gaither; William R. Moser

[57] ABSTRACT

An improved ultra-high bandwidth helical coil deflection structure for a cathode ray tube is described comprising a first metal member having a bore therein, the metal walls of which form a first ground plane; a second metal member coaxially mounted in the bore of the first metal member and forming a second ground plane; a helical deflection coil coaxially mounted within the bore between the two ground planes; and a resistive load disposed in one end of the bore and electrically connected to the first and second ground planes, the resistive load having an impedance substantially equal to the characteristic impedance of the coaxial line formed by the two coaxial ground planes to inhibit cavity resonance in the structure within the ultra-high bandwidth of operation. Preferably, the resistive load comprises a carbon film on a surface of an end plug in one end of the bore.

18 Claims, 5 Drawing Sheets

CAVITY RESONANCE ABSORPTION IN ULTRA-HIGH BANDWIDTH CRT DEFLECTION STRUCTURE BY A RESISTIVE LOAD

BACKGROUND OF THE INVENTION

The invention described herein arose in the course of, or under, Contract No. DE-AC08-88NV10617 between the United States Department of Energy and EG&G Energy Measurements, Inc.

This invention relates to cavity resonance absorption in ultra-high bandwidth CRT deflection structures. More particularly, this invention relates to such a CRT deflection structure having a coaxial line formed by a ground planes in the structure terminated by a resistive load having an impedance comparable to the characteristic impedance of the coaxial line.

Helically shaped coils have been used as slow wave deflection structures in cathode ray tubes (CRTs) for many years. They deflect the electrons in a CRT beam by creating a deflecting field that travels at the same velocity as the electrons in the beam, thereby gaining a high sensitivity and good bandwidth. Several different types and modifications of such structures have been described in the patent literature.

For example, Gross U.S. Pat. No. 4,035,687 shows a traveling wave tube with a helix delay line supported by a plurality of dielectric support rods extending along the delay line within a metallic sleeve with enlarged diameter end portions. To achieve a low reflection transition between the delay line and at least one of the coupling conductors, a metallic matching component comprising an arm is connected to the enlarged portion of the metallic sleeve. Projections extend from the arm between the support rods and terminate in close proximity to the delay line.

Lien et al. U.S. Pat. No. 4,158,791 discloses a helix-type traveling wave tube wherein a helix circuit is supported in a vacuum tube by axially extending ceramic support rods. On at least one of the rods is provided a frequency-sensitive lossy attenuating member which may be a meander line formed of a strip of resistive conductor bonded to the surface of the support rod. The meander line is a slow-wave circuit having an electrical length selected to resonate at the frequency to be suppressed as an open-ended transmission line.

Conquest U.S. Pat. No. 4,358,704 shows essentially the same structure shown in Lien et al. U.S. Pat. No. 4,158,791, except that the meander line formed of a strip of conductor bonded to the surface of the support rod is terminated at each end by a deposit of a lossy film such as pyrolytic carbon.

Kosmahl U.S. Pat. No. 4,564,787 discloses a traveling wave tube with a helix winding having a sever along the winding (interruption of the winding). Increased linearity to avoid intermodulation of signals being amplified is provided by decreasing the spacing between turns of the helix commencing at a downstream point.

Correll U.S. Pat. No. 4,812,707 describes a delay line deflection structure of the traveling wave type comprising a pair of helical coils wound around a common longitudinal axis wherein each of the coils has wide and narrow segments which alternate along the length of the coil in sequence with the turns of the coil. One coil has wide segments on the top and narrow segments on the bottom and the other coil has narrow segments on top and wide segments on the bottom. The coils are interleaved together so that the wide segments of one coil are interleaved with the narrow segments of the other coil. This disposition of the coils tends to effectively cancel out voltage gradients which develop along the coils.

Harper et al. U.S. Pat. No. 4,851,736 discusses formation of a helical waveguide slow wave structure wherein the helix is extended into a rectangular waveguide for coupling the slow wave structure to the source and the load. The rectangular waveguides are provided with short-circuiting termination plugs which are moved along the length of the waveguide to adjust the space between the spiral and the face of the plug.

Busacca et al. U.S. Pat. No. 4,859,907 discloses a traveling wave tube which is subdivided by cell-coupling irises separated by spacers provided with dielectric waveguide sections transparent to all frequencies above a prefixed frequency and terminated with a lossy load at an outer end of the dielectric waveguide to dissipate energy of all frequencies passed by the respective waveguide to the lossy load.

In ultra-high bandwidth CRT traveling wave deflection structures, i.e., above about 5 GHz, the structure's dimensions can be small enough to cause rf end-to-end cavity resonances at frequencies below the design bandwidth. These cavity resonances will distort the rf field seen by the electron beam and reduce the accuracy and precision performance of wide bandwidth CRTs to unacceptable levels.

The source of the cavity resonance is found to be characteristic of helical deflection coil structures not turn-to-turn isolated by guard bands or other means, and is the result of reflections between electrical discontinuities at the ends of the longitudinally continuous coaxial ground planes forming the microwave boundaries of the helix. Since the helical deflection structure consists of longitudinally concentric inner and outer ground surfaces with the helix occupying the space between them, a signal delivered to the beginning of the helix radiates along the longitudinal "cavity" formed by this volume, as well as following the bounded spiral of the helix.

If this longitudinal volume is shorted or left open at both ends by various inner ground supporting designs, then it becomes a resonating cavity with a frequency related to its longitudinal dimension. If one end is shorted and one open, the cavity resonances will occur at frequencies where the cavity length is $N\lambda/4$ where $\lambda$ is the wavelength and; $N=1,3,5, \ldots$ If both ends are shorted, the cavity resonances occur at $N\lambda/2$; $N=1,2,3, \ldots$ The graph of FIG. 1 shows such an undesirable cavity resonance occurring at 5.4 GHz in the rf helical deflection structure shown in the prior art structure of FIG. 2. FIG. 2 generally shows, at 2, an rf model of an actual structure and is thereby electrically representative of actual structures utilized within a CRT. As shown in FIG. 2, a helical deflection coil 10 is mounted coaxially within a cylindrical bore 22 of a metal housing 20. The metal walls of cylindrical bore 22 comprises one ground plane of the structure. Helical coil 10 is shown electrically connected, at each end, to a standard high temperature vacuum-tight electrical connector feedthrough 16. A central metal core 30 fitted within helical coil 10 forms a second ground plane. Central core 30 is mechanically supported coaxially within bore 22 by a first metal end plug 40, and at the opposite end by a second end plug 44. End plugs 40 and 44 are tightly fitted into the opposite ends of bore 22. While this structure provides a good mechanical support and ground continuity for central core 30, it by nature electrically shorts out both ends of the cavity formed by bore 22 and central core 30, i.e., the two ground planes, resulting in the undesirable cavity resonance shown in the graph of FIG. 1.

It would, therefore, be desirable to provide a helical deflection structure for an ultra-high bandwidth CRT wherein such undesirable cavity resonances are suppressed or eliminated.

SUMMARY OF THE INVENTION

Since these ground planes in a helical coil deflection structure are coaxially positioned, respectively, within the helical coil and surrounding the coil, the longitudinal volume formed by these concentric ground planes forms, in effect, a coaxial line with a calculable characteristic impedance. Therefore, in accordance with the invention, terminating the line at one end with a resistive load having a impedance comparable to the characteristic impedance will prevent an rf wave reflection, eliminating the cavity resonance shown in FIG. 1.

Therefore, the invention comprises an improved ultra-high bandwidth helical coil deflection structure for a cathode ray tube comprising a first metal member having a bore therein forming a first ground plane; a second metal member comprising a metal member coaxially mounted in the bore of the first member and forming a second ground plane; a helical deflection coil coaxially mounted within the bore between the two ground planes; and a resistive load fitted into one end of the cylindrical bore to terminate one end of the coaxial line formed by the first and second ground plane members. The resistive load is chosen to be comparable to the characteristic impedance of the coaxial line.

DETAILED DESCRIPTION OF THE INVENTION

The invention comprises an improved ultra-high bandwidth helical coil deflection structure for a cathode ray tube comprising a first metal member having a bore therein forming a first ground plane, a helical deflection coil coaxially mounted in the bore, and a metal member coaxially mounted within the deflection coil and forming a second ground plane, wherein the resonance characteristic of the cavity thus formed in the deflection structure is inhibited by terminating, with a resistive load, the coaxial line formed between the first ground plane and the second ground plane. The resistive load is chosen to have an impedance comparable to the characteristic impedance of the coaxial line. By use of the term "ultra-high bandwidth" is meant a frequency above about 5 GHz.

Figure 1:
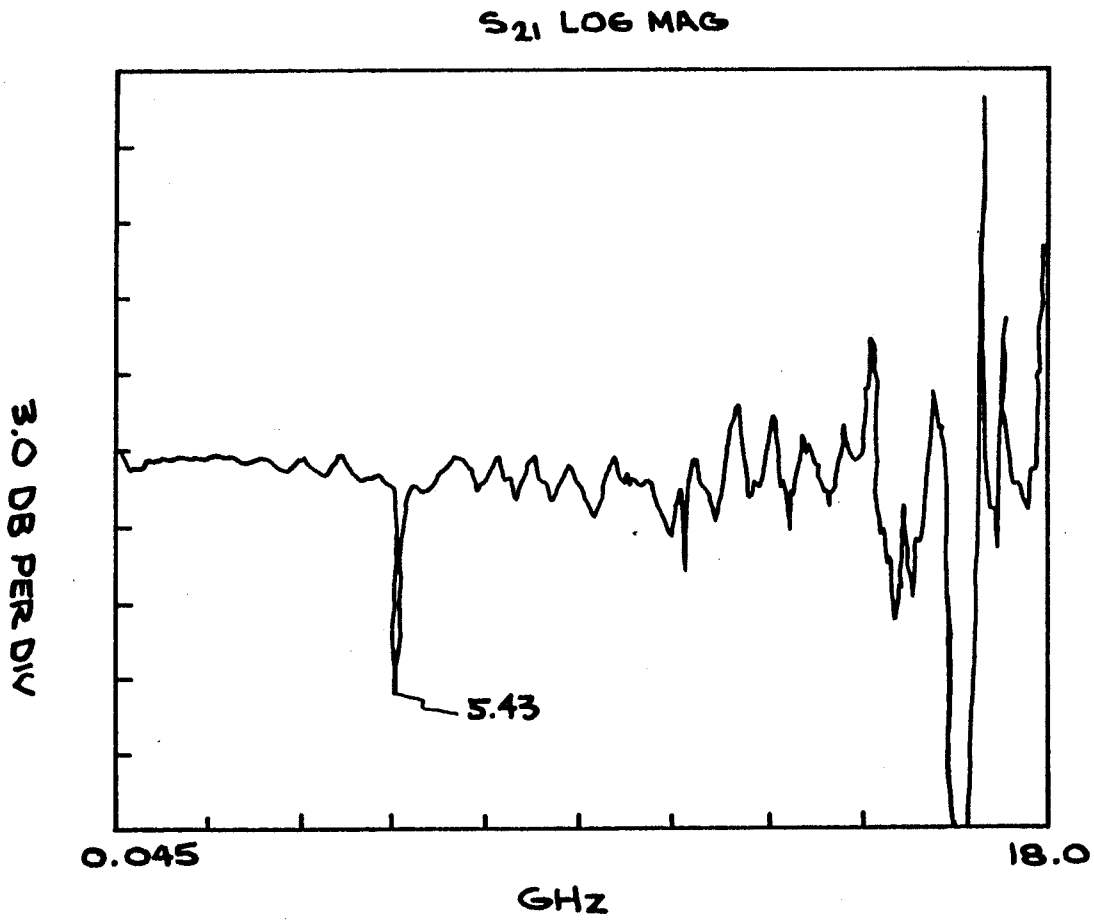
FIG. 1 (PRIOR ART)
FIG. 1 is a graph plotting frequency versus amplitude along the bandwidth of frequencies used in a prior art ultra-high bandwidth helical deflection structure.
Figure 2:
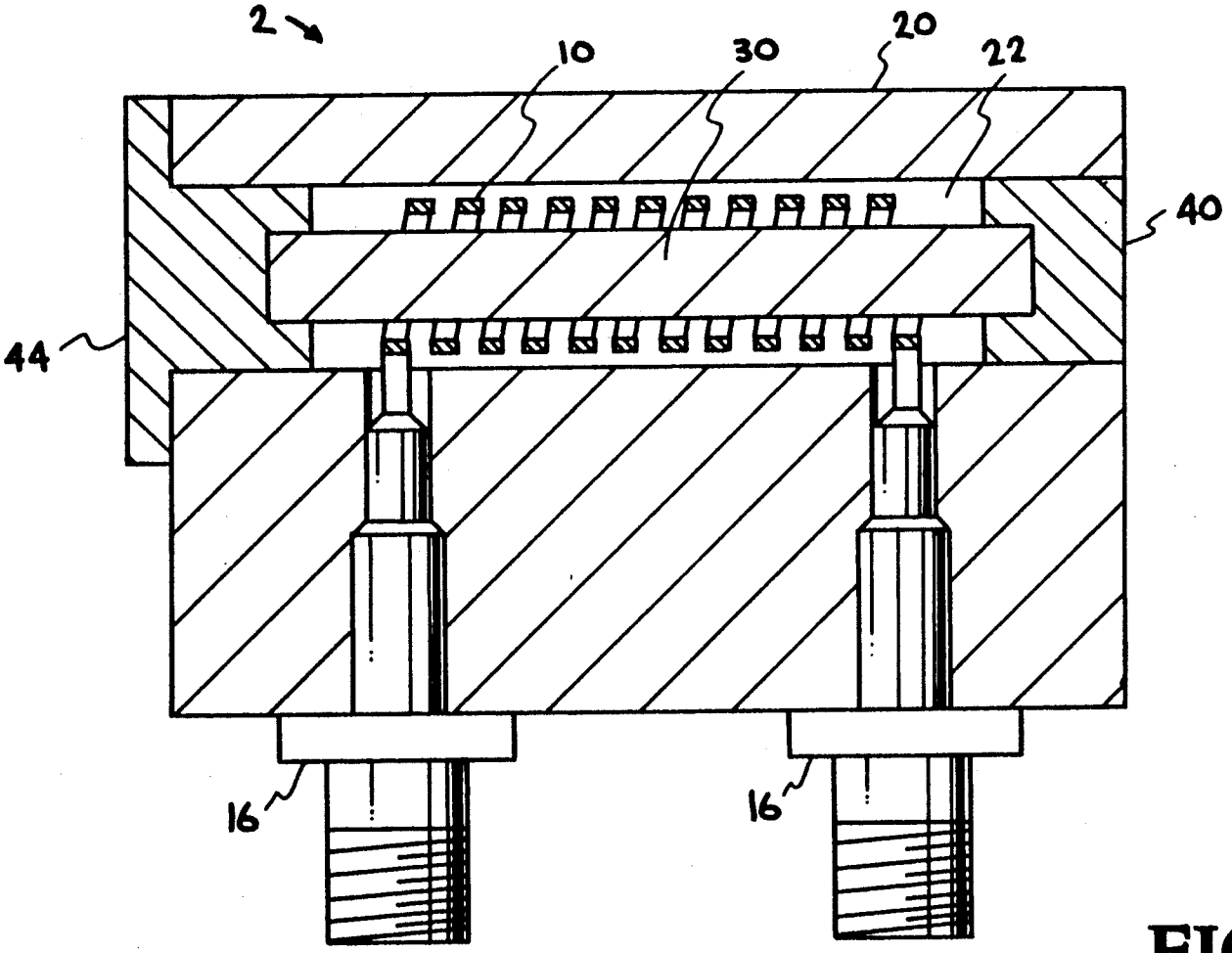
FIG. 2 (PRIOR ART)
FIG. 2 is a vertical cross-sectional view of a prior art ultra-high bandwidth helical deflection structure used in forming the graph of FIG. 1.
Figure 4:
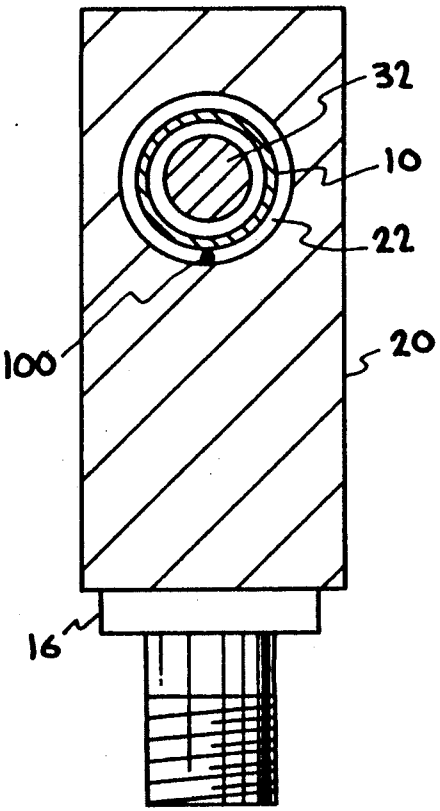
FIG. 4 is a cross-sectional view of the ultra-high bandwidth helical deflection structure of FIG. 3 taken along lines 4—4, and shown for simplicity as cylindrical in cross-section.

While the illustrated embodiments show, at least in FIG. 4, a cylindrical cross-section for the bore, the helical coil, and the metal member coaxially mounted therein, it should be noted that this is for illustrative purposes only. The bore and the central metal member (which respectively form the two ground planes) and the helical coil coaxially mounted therebetween, may be of any cross-section which will provide a coaxial disposition of the helical coil within the bore and the central metal member within the helical coil. The bore, the helical coil, and the central metal member may, therefore, be defined as having any cross-section which will permit coaxial disposition of the central metal member within the helical coil and the central metal member and the helical coil within the bore; including, but not limited to, cylindrical, elliptical, and oval-like cross-sections.

Therefore, the cross-section of the bore, the helical coil, and the central metal member will hereinafter be referred to as cylindrical in cross-section by way of illustration and not of limitation.

Figure 3:
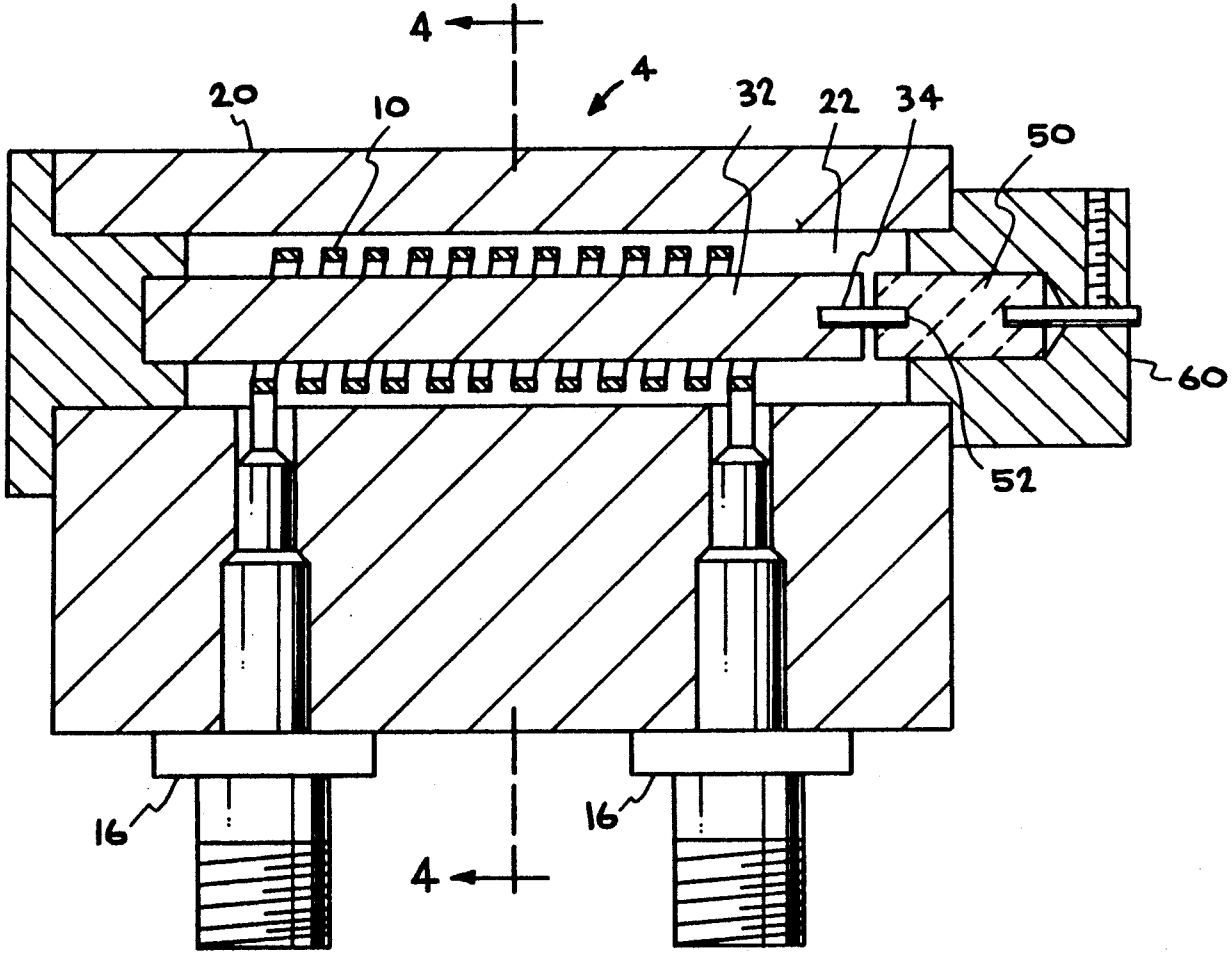
FIG. 3 is a vertical cross-sectional view of one embodiment of an ultra-high bandwidth helical deflection structure constructed in accordance with the invention.

Turning now to FIGS. 3 and 4, the improved ultra-high bandwidth CRT helical coil deflection structure of the invention is generally illustrated at 4. Where helical coil deflection structure 4 of the invention uses the same components as in prior art structure 2, the same numerals will be used. Helical coil deflection structure 4 comprises a helical deflection coil 10 mounted coaxially within a cylindrical bore 22 of a metal housing 20. The metal walls of cylindrical bore 22 comprises one ground plane of the structure. Helical coil 10 is shown, in FIG. 3, electrically connected, at each end, to standard high temperature feed-through vacuum-tight electrical connectors 16, such as commercially available from Kaman Instrumentation Corp., Colorado Springs, Colo.; Hermetic Seal Corp., Rosemead, Calif.; and Woburn CRT operation of EG&G/EM, Woburn, Mass. Connectors 16 provide external electrical contact to each end of coil 10. As seen in FIG. 4, when the deflection structure of the invention is incorporated into the vacuum envelope of a CRT device, electron beam 100 passes through structure 4 between helical coil 10 and cylindrical bore 22.

A central cylindrical metal core 32 is coaxially mounted within helical coil 10 and forms the second ground plane of the structure. The two ground planes formed, respectively, by cylindrical bore 22 and cylindrical metal core 32, form a coaxial line which, in accordance with the invention, is terminated by a resistor member 50 having an impedance comparable to the characteristic impedance of the coaxial line (see FIG. 3).

As shown in FIG. 3, cylindrical metal core 32 may be mechanically supported coaxially within bore 22, at one end, in accordance with the invention, by resistor member 50 which, in this embodiment of the invention, is mounted within a cylindrical metal plug 60 having an outer diameter substantially equal to the diameter of bore 22 so that plug 60 may be snugly fitted into bore 22. To centrally support central cylindrical core 32 within structure 4, a metal pin 52 may be coaxially received at one end into a bore in resistor member 50 and at its other end into a bore 34 in core 32. Alternatively, pin 52 may be formed as an integral part of either resistor member 50 or cylindrical core 32, and may be constructed of metal or insulative materials.

Resistor member 50 may be formed of any resistive material having the desired resistivity, as well as the ability to withstand the operating temperatures of deflection coil structure 4, which may range from about 0° C. to about 50° C., withstand processing temperatures to 400° C. (during construction of the deflection and/or CRT structures), and not outgas in high vacuum, i.e., in a vacuum of at least about $10^{-7}$ Torr or higher. Suitable resistive materials include carbon films deposited on a suitable ceramic substrate such as aluminum oxide, titanium oxide, or similar ceramic material. Resistor member 50 may be of any desired form that enables good electrical contact to core 32 and bore 22, and preferably also provides locational support to central metal member 32.

The impedance of the resistance load seen between first ground plane 22 and second ground plane 32 by the presence of resistor member 50 should be substantially equal or comparable to the characteristic impedance of the coaxial line formed by the two ground planes, as modified by the presence of coil 10 dielectric space or cavity formed by first ground plane 22 and second ground plane 32. By "substantially equal or comparable to" is meant that the impedance of the load seen between the first and second ground planes, because of the presence of resistor member 50, should be within 5% or less of the system characteristic impedance of the coaxial line formed by the two ground planes, as modified by the presence of coil 10.

The desired impedance of the load formed by varying the type of resistor material used, or by varying physical characteristics appropriate to the design of the resistive component, e.g., by varying the length, thickness, etc. of the resistor as will be discussed below.

Alternatively, the characteristic impedance of the coaxial line may be calculated and the characteristics of the resistor design and its resistor material then selected based on this calculation. For example, when the diameter of bore 22 (the first ground plane) is 4.01 millimeters (mm.) and the diameter of central core 32 (the second ground plane) is 2.18 mm., the approximate characteristic impedance of the coaxial line, when cylindrical in cross-section, may be calculated as follows:

$$Z_0 = \frac{138}{\sqrt{\epsilon}} \log_{10} \frac{D}{d}$$

where:

D=Diameter of bore 22 d=Diameter of core 32

$\epsilon$=Dielectric constant of the insulator (vacuum=1)

$$Z_0 = \frac{138}{\sqrt{1}} \log_{10} \frac{4.01}{2.18} = 36.6\Omega$$

Exact calculations may be made through the use of computational methods that also consider the presence of coil 10 in the dielectric space or cavity. However, from the approximate calculation, one can select the starting value of resistive material for resistor member 50 and from empirical testing, making use of an rf model such as described here, determine the actual system value, i.e., by empirically fine tuning of the calculated value.

Figure 5:
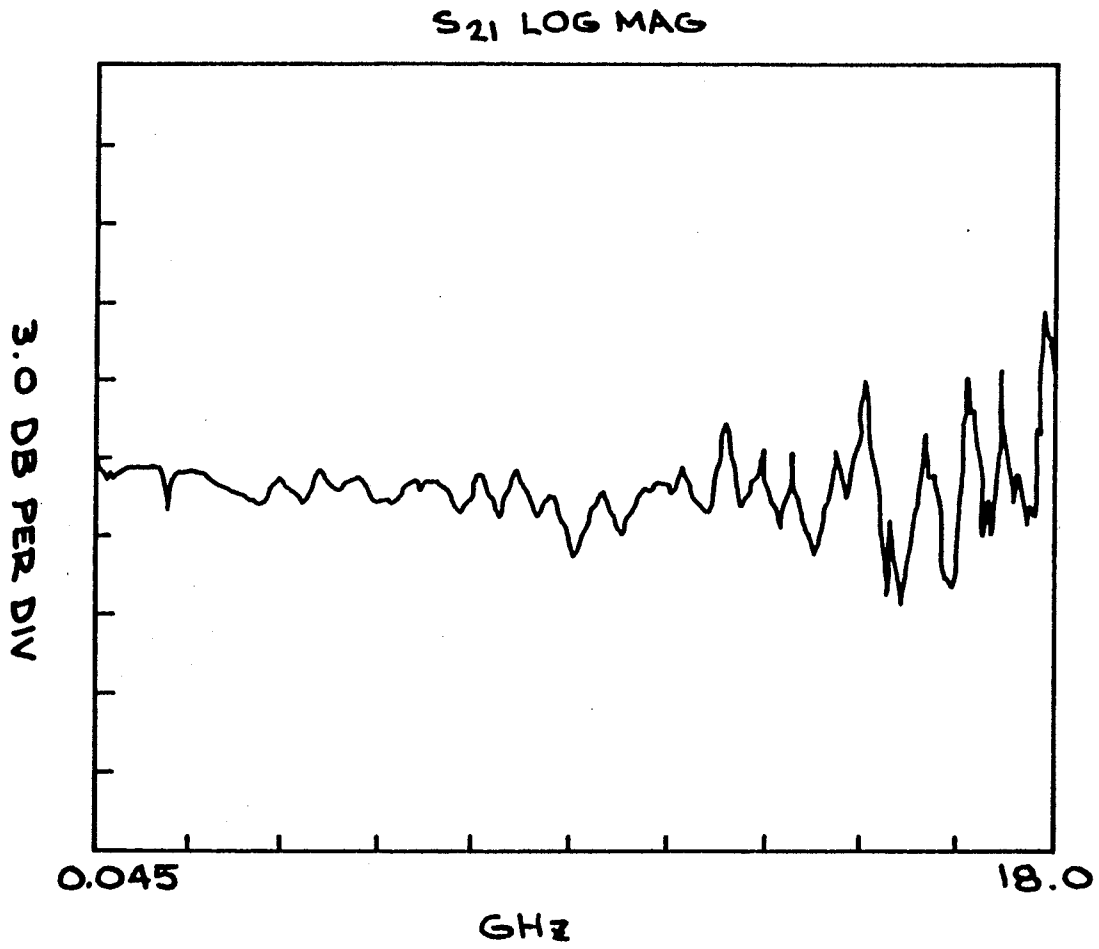
FIG. 5 is a graph plotting frequency versus amplitude along the bandwidth of frequencies used in the ultra-high bandwidth helical deflection structure of the invention shown in FIGS. 3 and 4.

As shown in the graph of FIG. 5, when the ultra-high bandwidth helical deflection structure of the invention is utilized at a frequency above about 5 GHz, no cavity resonance peaks are shown, indicating that terminating the ground planes in a resistive load having an impedance which approximately matches the characteristic impedance between the ground planes eliminates discernable cavity resonance in the structure.

Figure 6:
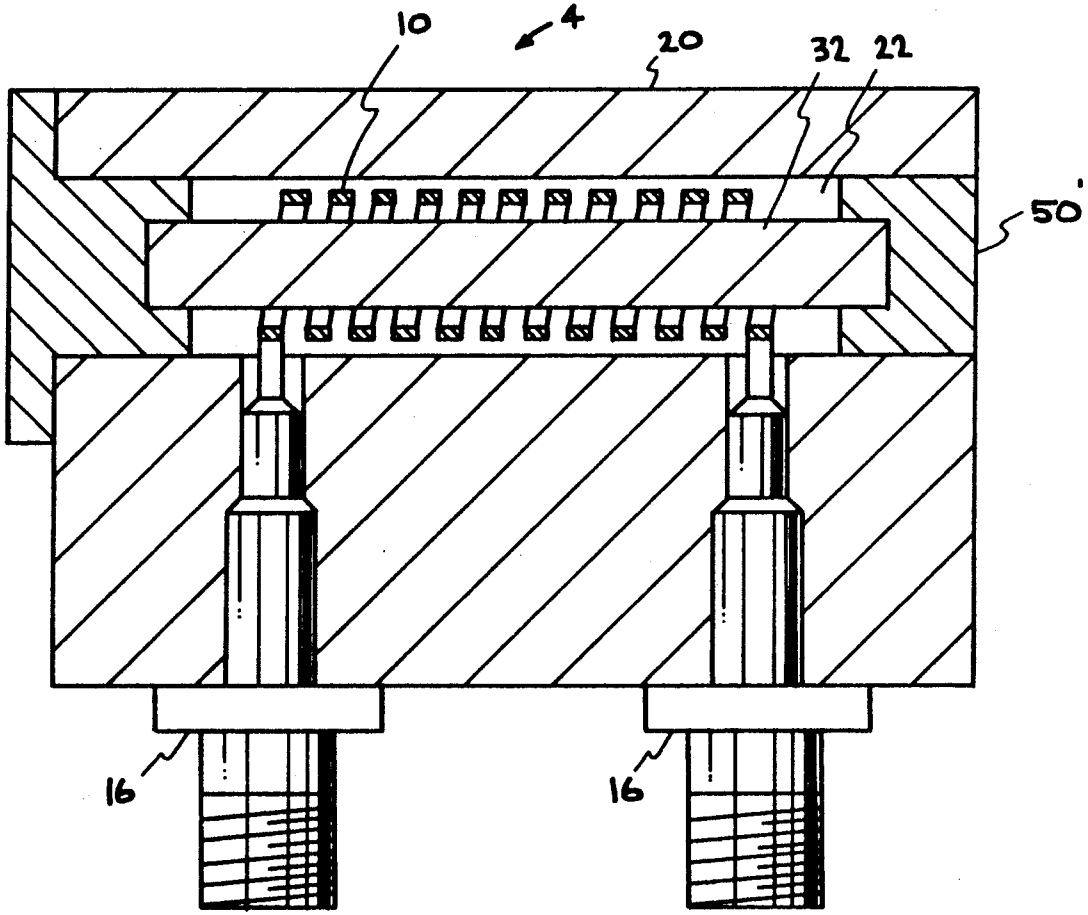
FIG. 6 is a vertical cross-sectional view of another embodiment of an ultra-high bandwidth helical deflection structure constructed in accordance with the invention.

Turning now to FIG. 6, another embodiment of the ultra-high bandwidth helical deflection structure is shown wherein metal plug member 60 is eliminated and replaced by a resistor member 50' which is of cylindrical cross-section, having the same diameter as cylindrical bore 22. In this embodiment, the impedance of resistor member 50' may be varied by the particular selection of the material used in forming resistor member 50', or by varying other resistance related parameters of resistor member 50'.

Figure 7:
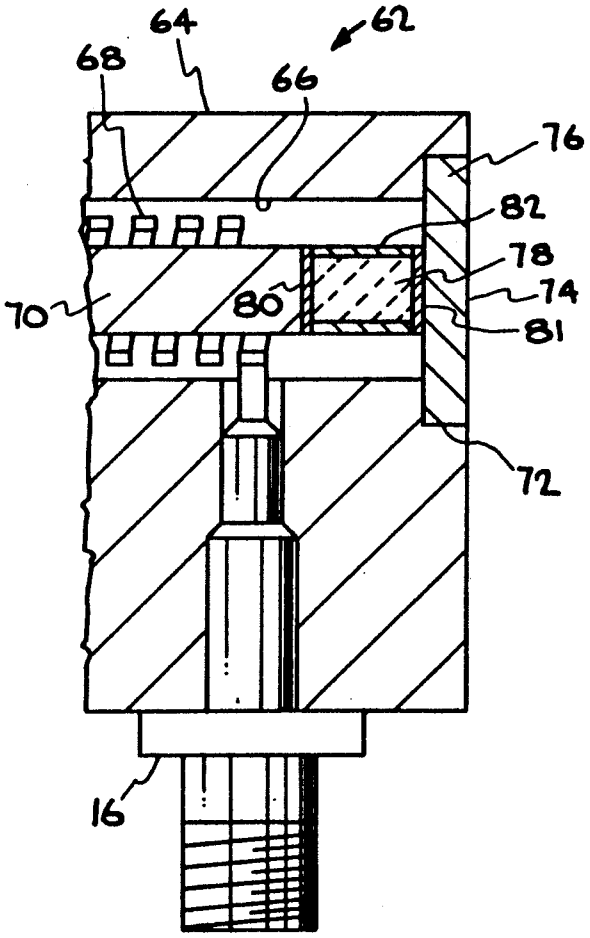
FIG. 7 is a fragmentary vertical cross-sectional view of a preferred embodiment of an ultra-high bandwidth helical deflection structure constructed in accordance with the invention.

Turning now to FIG. 7, yet another embodiment of the invention is shown wherein the resistor comprises a carbon film 82 which permits the resistance, for example, to be varied by varying the thickness of the carbon film. As shown in FIG. 7, a modified deflection structure 62 is depicted comprising a metal housing 64 containing a bore 66 with a coaxial coil 68 coaxially mounted within bore 66 and a central metal core member 70 coaxially mounted within coil 68 so that bore 66 and central metal core member 70 form a microwave cavity similar to the cavity formed by bore 22 and central metal member 32, described above.

In this embodiment, housing 64 is provided with an enlarged counterbore 72 at one end of bore 66 into which is fitted a metal end plug 74. Metal end plug 74 is provided with an enlarged shoulder or lip 76 which preferably has the same cross-section as counterbore 72 to permit a snug fit of plug 74 into counterbore 72.

End plug 74 is joined to a coaxial ceramic shank 78 of smaller cross-section than bore 66 which coaxially extends into bore 66 to make contact with central metal core member 70. Ceramic shank 78 is metallized on each end using industry standard processes to facilitate joining shank 78 to end plug 74 at one end and metal core member 70 at the opposite end of ceramic shank 78, as well as to make good electrical contact with a resistive film to be applied thereto as will be described. Ceramic shank 78 is preferably fastened to end plug 74 and metal core member 70 by brazing, respectively, metallized opposite ends 80 and 81 thereon to end plug 74 and metal core member 70 to provide mechanical support and location for metal member 70 within bore 66.

In accordance with this embodiment of the invention, the surface of ceramic shank 78 is coated with resistor film 82 of resistive material such as carbon which provides the resistive termination of the coaxial line formed by bore 66 and metal core member 70. In this embodiment, the amount of the terminating resistance provided between the metal walls of bore 66 and metal core member 70 may be varied by varying the length of shank 78 or by varying the thickness of resistive material comprising film 82.

It should be further noted that end plug 74 may be constructed entirely of ceramic, in which case end surface 80 and the surface of shoulder 76 would be metallized to respectively provide electrical connection to metal core member 70 and the metal wall of bore 66, as well as provide electrical connections to the respective ends of resistive material film 82.

Thus, the ultra-high bandwidth helical deflection structure of the invention mitigates or substantially eliminates cavity resonance in the deflection structure by terminating the coaxial inner and outer ground planes within the structure at one end by a resistive load having an impedance matched to the characteristic impedance of the coaxial line formed by the two coaxially disposed ground planes, and that portion of the helical deflection coil within the dielectric space or cavity formed by the bore and the central metal member.

While specific embodiments of the ultra-high bandwidth helical deflection structure of the invention have been illustrated and described for practicing this invention, modifications and changes of the apparatus, parameters, materials, etc. will become apparent to those skilled in the art, and it is intended to cover in the appended claims all such modifications and changes which come within the scope of the invention.

What is claimed is:

1. In an ultra-high bandwidth helical coil deflection structure for a cathode ray tube comprising a first metal member having a bore therein with a central axis, said bore establishing a first ground plane; a second metal member coaxially mounted, with respect to said central axis, within the bore of said first metal member and establishing a second ground plane; and a helical deflection coil coaxially mounted, with respect to said central axis, within said bore and spaced between said two ground planes, wherein said first and second ground planes establish a coaxial line having a characteristic impedance; the improvement comprising a resistive load coaxially disposed in an end of said bore and electrically coupled between said second metal member comprising said second ground plane and a wall of said bore comprising said first ground plane to inhibit cavity resonance in said structure.

2. The ultra-high bandwidth helical coil deflection structure of claim 1 wherein said resistive load has an impedance comparable to said characteristic impedance of said coaxial line established by said first and second ground planes.

3. The ultra-high bandwidth helical coil deflection structure of claim 2 wherein said end of said bore is fitted with a plug which is mechanically coupled to said second metal member and which supports said resistive load.

4. The ultra-high bandwidth helical coil deflection structure of claim 3 wherein said plug is provided with a shank portion, which is mechanically and electrically coupled to said second metal member; and said resistive load is disposed on a surface of said shank portion.

5. The ultra-high bandwidth helical coil deflection structure of claim 4 wherein said second metal member is fastened to an end of said shank portion on said plug and said resistive load comprises a resistive film disposed on at least said surface of said shank portion of said plug.

6. The ultra-high bandwidth helical coil deflection structure of claim 5 wherein said resistive film comprises a carbon film.

7. The ultra-high bandwidth helical coil deflection structure of claim 3 wherein said plug is mechanically and electrically coupled to one end of said resistive load and an opposite end of said resistive load is mechanically and electrically coupled to said second metal member.

8. The ultra-high bandwidth helical coil deflection structure of claim 2 wherein a support member is mechanically coupled to said resistive load and said second metal member to provide mechanical support for said second metal member within said bore.

9. The ultra-high bandwidth helical coil deflection structure of claim 2 wherein said resistive load disposed in said end of said bore has a cross-sectional area approximately equal to a cross-sectional area of said bore which is perpendicular to said central axis.

10. The ultra-high bandwidth helical coil deflection structure of claim 2 wherein said structure is operated at a frequency of at least about 5 GHz.

11. An improved ultra-high bandwidth helical coil deflection structure for a cathode ray tube comprising:

a) a first metal member having a bore with metal walls and a central axis therein, said metal walls establishing a first ground plane;

b) a second metal member coaxially mounted, with respect to said central axis, within the bore of said first metal member and establishing a second ground plane;

c) a helical deflection coil coaxially mounted, with respect to said central axis, within said bore and spaced between said two ground planes; and d) a resistive load coaxially mounted, with respect to said central axis, in an end of said bore and electrically coupled between said first and second ground planes to terminate one end of a coaxial line established by said first and second ground plane members to thereby inhibit cavity resonance in said structure, said resistive load having an impedance substantially equal to a characteristic impedance of said coaxial line.

12. The ultra-high bandwidth helical coil deflection structure of claim 11 wherein said end of said bore is provided with a plug which is mechanically coupled to said second metal member and which supports said resistive load; and said resistive load comprises a resistive film disposed on a surface of a portion of said plug which extends into said bore.

13. The ultra-high bandwidth helical coil deflection structure of claim 12 wherein said plug is provided with a shank portion, which is mechanically and electrically coupled to said second metal member; and said resistive film is disposed on at least a surface of said shank portion of said plug.

14. The ultra-high bandwidth helical coil deflection structure of claim 13 wherein said resistive film comprises a carbon film.

15. The ultra-high bandwidth helical coil deflection structure of claim 11 wherein said second metal member establishing said second ground plane is mechanically coupled to said resistive load to support said second metal member within said structure.

16. An improved ultra-high bandwidth helical coil deflection device for a cathode ray tube comprising:

a) a metal housing having a cylindrical bore therein with a central axis, said bore having walls establishing a first ground plane;

b) a metal member coaxially mounted, with respect to said central axis, in said bore and establishing a second ground plane;

c) a helical deflection coil coaxially mounted, with respect to said central axis, within said bore and spaced between said two ground planes, said helical coil having first and second ends which are electrically coupled to respective electrical connectors mounted to said housing; and d) a resistive load comprising a carbon film coaxially mounted in an end of said bore between said first and second ground planes and beyond one of said first and second ends of said helical coil to terminate one end of a coaxial line established by said first and second ground plane members to thereby inhibit cavity resonance in said structure, said resistive load having an impedance substantially equal to a characteristic impedance of said coaxial line.

17. The improved ultra-high bandwidth helical coil deflection device for a cathode ray tube of claim 16 wherein said carbon film resistive load is disposed on a surface of an end plug, said surface is received in said end of said bore, and said carbon film resistive load is electrically coupled to said first and second ground planes.

18. The improved ultra-high bandwidth helical coil deflection device for a cathode ray tube of claim 17 wherein said surface of said end plug on which said carbon film resistive load is disposed comprises a shank portion on said end plug and an end of said shank portion is mechanically fastened to said metal member establishing said second ground plane.

* * * * *